United States Patent [19]

Stengard

[11] Patent Number: 4,853,670

[45] Date of Patent: Aug. 1, 1989

[54] SURGE ARRESTER

[75] Inventor: Peter Stengard, Ludvika, Sweden

[73] Assignee: Asea Brown Boveri AB, Vasteras, Sweden

[21] Appl. No.: 159,036

[22] Filed: Feb. 19, 1988

[30] Foreign Application Priority Data

Feb. 23, 1987 [SE] Sweden ..... 8700732

[51] Int. Cl.[4] ..... H01C 7/10

[52] U.S. Cl. ..... 338/21; 361/126

[58] Field of Search ..... 338/21; 361/117, 126, 361/127, 128

[56] References Cited

U.S. PATENT DOCUMENTS 4,262,318 4/1981 Shirakawa et al. ..... 338/21 X
4,335,417 6/1982 Sakshaug et al. ..... 338/21 X
4,352,140 9/1982 Axelsson et al. ..... 361/127

FOREIGN PATENT DOCUMENTS 0196370 10/1986 European Pat. Off. .
2073965 10/1981 United Kingdom .

*Primary Examiner*—E. A. Goldberg
*Assistant Examiner*—M. M. Lateef
*Attorney, Agent, or Firm*—Watson, Cole, Grindle & Watson

[57] ABSTRACT

An open surge arrester has an active part with a number of surge arrester elements of a metal oxide varistor material, arranged between two end fittings, and, a retaining part with a number of rods of an insulating material for mechanically holding the surge arrester together. Both the active part and the retaining part are exposed to the environment surrounding the surge arrester and are individually profiled to provide an extended creep distance between the end fittings.

9 Claims, 1 Drawing Sheet

SURGE ARRESTER

TECHNICAL FIELD

The present invention relates to a surge arrester comprising an active part including at least one substantially cylindrical surge arrester element of metal oxide varistor material, arranged between two end fittings, and a retaining part including at least one rod of insulating material extending between the end fittings for keeping the surge arrester together mechanically. The surge arrester is primarily intended for voltages of the order of magnitude of 100 kV and thereabove, but the same embodiment, in principle, may be used also for lower voltages.

BACKGROUND ART

A surge arrester of the above-mentioned kind is previously known from U.S. Pat. No. 4,262,318. In this surge arrester a plurality of surge arrester elements in the form of zinc oxide varistors are arranged in a stack and enclosed within a housing of porcelain with a gap between the housing and the varistor stack. In the event of a fault inside the surge arrester with a resultant short-circuit current and violent gas development, a high pressure may be built up in the above-mentioned gap. In such a design, therefore, special and often expensive measures for pressure relief have to be taken so that the housing does not burst in an uncomfortable manner, causing secondary damage by splinters being thrown out. Other drawbacks in connection with this design are that it requires a relatively large space and that only a limited number of parallel varistor stacks can be accomodated within one and the same porcelain housing.

Also a surge arrester in which the arrester elements are provided with a tightly surrounding housing of a shrinkable plastic or rubber material is previously known (GB-A-2 073 965). As mechanical reinforcement of this surge arrester it has been proposed to arrange an insulating rod between the end fittings of the surge arrester. This rod extends through an axial hole in the sruge arrester elements. Such a design presupposes a gas-tight housing which shields the rod from the outside environment, since there is otherwise a risk of creeping currents whcih may cause a flash-over in the gap which is inevitably formed between the rod and the hole wall. For higher voltages this surge arrester is less suitable.

SUMMARY OF THE INVENTION

The object of the present invention is to provide a surge arrester designed for high voltages, which does not suffer from the drawbacks connected with the above-mentioned prior art designs. This is achieved according to the invention by a surge arrester, in which both the active part and the retaining part are exposed to the environment surrounding the surge arrester and are individually profiled to provide an extended creep distance between the end fittings.

By using insulating pull rods for mechanically holding the surge arrester together, and by profiling the pull rods and the active surge arrester elements to obtain a sufficient creep distance, the outer porcelain housing can be dispensed with. This results, inter alia, in the following advantages (in comparison with a surge arrester with a porcelain housing):

(a) There is no enclosed gas volume in the surge arrester and consequently no risk of explosion caused by a pressure increase in the event of a fault inside of the surge arrester. Accordingly, components of the surge arrester cannot be ejected and cause secondary damage.

(b) The surge arrester can be constructed with, in principle, an unlimited number of parallel legs (stacks of surge arrester elements) at a relatively low cost, since one is not confined to the space within a porcelain housing.

(c) The surge arrester will have a lower overall height than a surge arrester with a porcelain housing, which, inter alia, is due to the fact that the latter requires larger end fittings.

(d) The weight of the surge arrester is reduced.

(e) The cooling of the active parts of the surge arrester is improved.

The necessary creep distance of the active part of the surge arrester can be achieved in several different ways:

For example, the envelope surfaces of the surge arrester elements can be tightly surrounded by mutually overlapping protective rings and guide rings, which are profiled and made of a material resistant to creeping current.

Another possibility is to design the actual surge arrester element as an elongated element with a plurality of creep distance extending annular projections, arranged one after the other in the axial direction of the surge arrester element, which projections are of the same material as the material in the rest of the surge arrester element and which form, together with the rest of the surge arrester element, a coherent unit (in principle, as shown in EP-A-0 196 370). The envelope surface is suitably provided with a protective coating of an electrically insulating material.

According to a third embodiment, the active part, which may comprise a plurality of surge arrester elements stacked on top of each other, is provided with a tightly surrounding casing of a plastic or rubber material resistant to creeping current, which casing has been applied by shrinkage and is provided with grooves.

BRIEF DESCRIPTION OF THE DRAWING

The invention will be described in greater detail with reference to an embodiment shown on the accompanying drawing, wherein FIG. 3 is an axial section through three series-connected varistor blocks with envelope protective means associated with the surge arrester and FIGS. 4 and 5 are side views, in half-section, of two embodiments of an insulating rod for mechanically holding the surge arrester together.

DESCRIPTION OF THE PREFERRED EMBODIMENT

Figure 1:
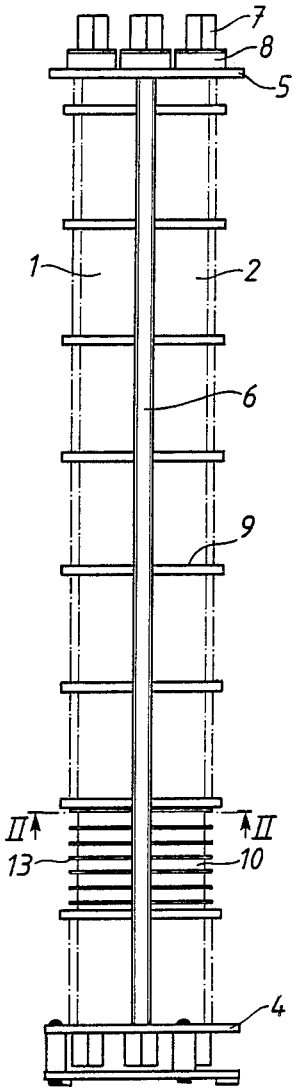
FIG. 1 is a side view of a surge arrester designed according to the invention.
Figure 2:
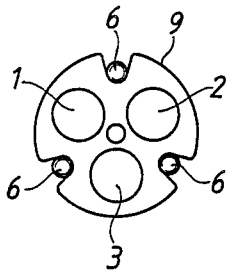
FIG. 2 is a cross-section through the sruge arrester along the line II—II in FIG. 1.
Figure 3:
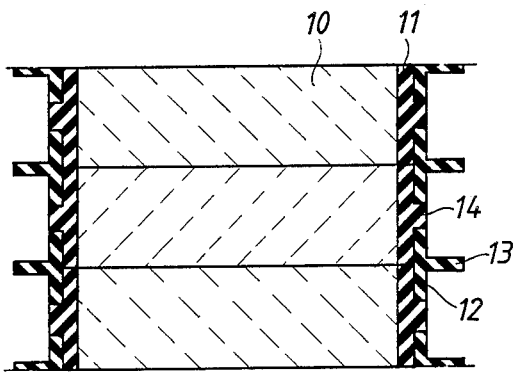

The surge arrester shown in FIGS. 1 and 2 has an active part comprising three parallel legs in the form of stacks 1, 2, 3 of cylindrical, coaxially arranged ZnO varistor blocks 10 (FIG. 3). The stacks are arranged between a bottom plate 4 and a top plate 5 and is held together mechanically by three insulating pull rods 6 of, for example, glass fibre, which are arranged evenly spaced from each other around the periphery of the surge arrester. Instead of using three rods, it would also have been possible to use, for example, one single rod arranged in the longitudinal axis of the surge arrester between the three varistor stacks. The rods 6 are provided with end nuts 7. To achieve the necessary contact pressure between the varistor blocks, a spring package 8 is arranged around each pull rod 6 at the top end plate 5. Alternatively, these spring packages 8 may be arranged at one end of each varistor stack.

The surge arrester shown may have a length of, for example, 2 m, and each stack may comprise, for example, about 70 varistor blocks. For mechanically reinforcing the surge arrester, a number of metallic support plates 9 are arranged between the stacks and are evenly spaced between the end plates 4, 5. These support plates 9 are made with recesses which are adapted to the cross-section of the varistor blocks and which form seats for the adjacent blocks. Thus, the plates 9 extend across the stacks and form electric parallel connections therebetween. FIG. 3 shows how the varistor stacks are built up on the distances between the support plates 9. The end surfaces of the circular-cylindrical varistor blocks 10 are provided with electrode coatings, for example in the form of layers of copper or aluminium, applied by plasma spraying, whereby the varistor blocks in the stacks are series-conneted. Further, the blocks are provided with electrically insulating envelope protective means of, in principle, the same design as that shown in U.S. Pat. No. 4 352 140. The envelope protective means consists of protective rings 11, for example of silicon rubber or EPDM rubber tightly surroudning the varistor blocks, and of separate guide rings 12 of, for example, polypropylene. These guide rings 12 enable the varistor blocks to be stacked on top of each other while being guided in the lateral direction. At the same time they seal the varistor stack, so that ionized gas which may form because of glow discharge between two adjacent blocks is unable to spread outwards. The guide rings 12 are provided with a radially projecting, surrounding fin 13 for extending the creep distance along the stack. The protective rings 11 have almost the same axial extension as the varister blocks and are provided with an external, surrounding elevation 14 to fix the guide rings 12 in the axial direction.

Furthermore, because of the creep distance-extending fin 13 of the guide rings 12, the mechanical stability of the guide rings 12 will be increased, which entails a possibility of considerably reducing the number of metallic support plates 9, or even of omitting these plates competely.

To achieve a sufficient creep distance along the rods 6, which are arranged for mechanically supporting the surge arrester, these rods 6 can be profiled, for example by providing them with grooves or threaded slots 15, as shown in FIG. 4. The rods 6 may also be plain and the necessary creep distance be obtained by, for example, shrin-king-on of a groove shrinking hose 16, as shown in FIG. 5. Such hoses are available on the market.

The surge arrester shown in the drawing is primarily designed for indoor use as overvoltage protection for electric high voltage equipment set up in a protected environment, for example thyristor valves for high voltage direct current. Howver, the design principle suggested according to the invention may advantageously be used for outdoor surge arresters as well.

The invention is not limited to the embodiment shown but can be materialized in many ways within the scope of the appended claims.

We claim:

1. A surge arrester comprising, an active part including at least one substantially cylindrical surge arrester element of metal oxide varistor material arranged between two end fittings, and a retaining part including at least one rod of insulating material extending between the end fittings for mechanically holding the surge arrester together, both the active part and the retaining part being exposed to the environment surrounding the surge arrester, means on the active part and on the retaining part for together providing an extended creep distance between the end fittings, said means on said retaining part being defined by said rod having external threads such that the creep distance therealong between the end fittings of the surge arrester is at least 30% longer compared to a corresponding rod having a smooth circular-cylindrical shape.

2. A surge arrester comprising, an active part including at least one substantially cylindrical surge arrester element of metal oxide varistor material arranged between two end fittings, and a retaining part including at least one rod of insulating material extending between the end fittings for mechanically holding the surge arrester together, both the active part and the retaining part being exposed to the environment surrounding the surge arrester, means on the active part and on the retaining part for together providing an extended creep distance between the end fittings, said means on said retaining part comprising a creep distance-extending, shrunk-on casing in the form of a grooved shrink hose.

3. Surge arrester according to claim 1 or 2, wherein the active part comprises a plurality of surge arrester elements arranged coaxially in a stack, the end surfaces of said surge arrester elements being provided with low resistive contact layers.

4. Surge arrester according to claim 2, wherein envelope surfaces of the surge arrester elements are tightly surrounded by annular protective members of insulating material, which are formed so as to overlap each other between surge arrester elements positioned adjacent to each other, said protective members being formed with at least one creep distance-extending annular projection defining said means on said active part.

5. Surge arrester according to claim 1 or 2, wherein the surge arrester element is formed at an envelope surface thereof with a plurality of creep distance-extending annular projections arranged one after the other in the axial direction of the surge arrester element and defining said means on said active part, said projections being of the same material as the material in the rest of the surge arrester element and forming together with the rest of the surge arrester element a coherent unit.

6. Surge arrester according to claim 3, wherein the envelope surface of the surge arrester element is provided with a protective coating of an electrically insulating material, said coating being formed and secured on the surge arrester element.

7. Surge arrester according to claim 6, wherein the coating consists of a layer of a polymer or elastomer, or of a layer of glass, or of a ceramic material.

8. Surge arrester according to claims 1 or 2, wherein the means on the active part comprises a tightly surrounding casing, applied by means of shrinkage and provided with grooves, of a plastic or rubber material, shrinkable by heating, which is resistant to creeping current.

9. Surge arrester according to claims 1 or 2, wherein the active part comprises a plurality of columns arranged side-by-side in parallel between the end fittings, each of said columns including at least one said surge arrester element.

* * * * *

UNITED STATES PATENT AND TRADEMARK OFFICE

CERTIFICATE OF CORRECTION

PATENT NO. : 4,853,670

DATED : August 1, 1989

INVENTOR(S) : Peter Stengard

It is certified that error appears in the above-identified patent and that said Letters Patent is hereby corrected as shown below:

In the title page, block 75, correct the inventorship to read --Inventors: Bengt Johnnerfelt, Bengt Thors and Peter Stengard, all of Ludvika, Sweden--

Signed and Sealed this

Twenty-first Day of July, 1992

*Attest:*

DOUGLAS B. COMER

*Attesting Officer*

*Acting Commissioner of Patents and Trademarks*